313-414 SR
6/29/82 XR 4,337,409

United States Patent [19]

van der Heijden et al.

[11] 4,337,409

[45] Jun. 29, 1982

[54] COLOR DISPLAY TUBE WITH CONTROL GRID POSITIONING FEATURE

[75] Inventors: Antonius W. F. van der Heijden; Jörg Brambring; Johannes M. J. Spruyt, all of Eindhoven, Netherlands

[73] Assignee: U.S. Philips Corporation, New York, N.Y.

[21] Appl. No.: 144,793

[22] Filed: Apr. 28, 1980

[30] Foreign Application Priority Data

May 25, 1979 [NL] Netherlands ..... 7904114

[51] Int. Cl.³ ..... H01J 29/02

[52] U.S. Cl. ..... 313/409; 313/414

[58] Field of Search ..... 313/409–417

[56] References Cited

U.S. PATENT DOCUMENTS 3,295,001 12/1966 Burdick et al. ..... 313/448
3,732,450 5/1973 Mayers ..... 313/409
3,906,279 9/1975 Linssen ..... 313/409
4,063,128 12/1977 Hughes ..... 313/409
4,086,513 4/1978 Evans ..... 313/414

*Primary Examiner*—Eli Lieberman
*Attorney, Agent, or Firm*—Robert J. Kraus

[57] ABSTRACT

A color display tube includes in an evacuated envelope, an electron gun system for producing three electron beams directed onto a display window. For each electron beam the electron gun system is provided with a cathode which is secured in a cup-shaped control grid having an aperture. The control grids are secured to a cup-shaped anode by means of a plate of electrically insulating material. The electron gun system may be constructed with a focusing electrode which is common for the three electron beams and a common accelerating electrode. A sleeve-shaped electrode may be secured to the anode and the focusing electrode is secured thereto by means of a ring of electrically insulating material.

4 Claims, 5 Drawing Figures

COLOR DISPLAY TUBE WITH CONTROL GRID POSITIONING FEATURE

BACKGROUND OF THE INVENTION

The invention relates to a colour display tube comprising in an evacuated envelope an electron gun system for producing three electron beams directed onto a display window. For each electron beam the electron gun system is provided with a cathode which is secured in a cup-shaped apertured control grid by means of an electrically insulating material. The electron gun system further includes a common anode having a respective aperture for each electron beam and means to focus the electron beams on the display window.

Such a colour display tube is known from Netherlands Pat. application No. 7402421 which corresponds to U.S. Pat. No. 3,973,161. This tube comprises an electron gun system which is provided with a separate cathode for each of three electron beams. Each cathode is secured in a cup-shaped, apertured control grid by means of a ring of ceramic material. The anode is formed by a plate which is common for the three electron beams and has an aperture for each electron beam. The means to focus the electron beams on the display window are formed by two electrodes which are common for the three electron beams.

In such a tube the electrodes of the electron gun system should be positioned accurately with respect to each other. This applies in particular to the mutual position of the control grids and the centering of the aperture in each of the control grids relative to the corresponding aperture in the anode. During assembly of the electron gun system, the electrodes are positioned relative to each other in an assembly jig. The position of the electrodes is fixed by means of suspension braces connected thereto, the ends of which are sealed in glass rods. As a result of the heating up of the suspension braces and the electrodes when the glass rods are depressed, deviations easily occur in the adjusted position of the electrodes. Moreover, the adjusted position of the electrodes varies as a result of expansion of the suspension braces and of the electrodes during warming up of the tube during operation, which results in a variation of the convergence of the three electron beams on the display window.

SUMMARY OF THE INVENTION

It is an object of the invention to provide a colour display tube in which the position of the electrodes of the electron gun system is accurately fixed and in which temperature effects have a small influence on the position of the electrodes.

According to the invention, a colour display tube of the kind mentioned in the opening paragraph is characterized in that the anode is cup-shaped and the cup-shaped control grids are secured in a plate of electrically-insulating material, which plate is secured to the cup-shaped anode. The plate of electrically insulating material may be manufactured from a ceramic material. Since the three control grids are secured in a plate of ceramic material, the suspension braces of the individual control grids and the depression of glass rods on said braces is omitted. Because of this, the adjusted mutual position of the control grids and the centering of the apertures in the control grids relative to the apertures in the anode can be better maintained.

It is to be noted that U.S. Pat. No. 3,772,554 discloses an electron gun system which includes three individual cathodes and a common control grid and a common anode for the three electron beams. Both the control grid and the anode are in the form of a plate having a respective aperture for each electron beam. In such an electron gun system the electron beams cannot be controlled individually at the control grid and all control signals must be supplied to the cathodes. Practically this is not deemed desirable and the electron beams are preferably controlled both on individual control grids and on the cathode. In a colour display tube in accordance with the invention the control grids are accommodated in a plate of ceramic material so as to be electrically separated in such manner that the control grids can be driven individually.

A colour display tube in accordance with the invention may be characterized in that a plate having three embossed parts, each provided with an aperture, is connected on the side of the anode facing the display window. The plate constitutes an element in the electron gun system in which the aperture in each of the embossed parts serves to restrict the cross-section of the electron beam at the area of the focusing lens so as to obtain the desired shape of the spot of the electron beams on the display window.

In such an assembly of control grids and anode the means for focusing the electron beams may comprise a focusing lens of the so-called bipotential type consisting of a focusing electrode and an accelerating electrode; a focusing lens of the so-called unipotential type, consisting of a first accelerating electrode, a focusing electrode and a second accelerating electrode, in which the first and the second accelerating electrode during operation of the tube having the same potentials; or a focusing lens of the so-called tripotential type consisting of a first electrode, a second electrode and a third electrode, in which the three electrodes during operation of the tube have different potentials. The focusing means may also be formed by four successive electrodes which may be interconnected electrically in various manners. Embodiments of this latter type are disclosed, for example, in U.S. Pat. Nos. 3,995,194 and 3,863,091.

The electrodes of the focusing lens may be constructed with individual electrodes for each electron beam or with electrodes which are common for the three electron beams. A suitable embodiment of a colour display tube in accordance with the invention is characterized in that the means for focusing the electron beams are formed by a focusing electrode and an accelerating electrode which are common for the three electron beams. The focusing electrode comprises a first and a second cup-shaped part, which parts are secured together at their open ends. The focusing electrode is provided with an aperture for each respective electron beam at each end. By constructing the electrodes of the focusing lens so as to be common for the three electron beams, good positioning accuracy of the electrodes is obtained.

Another embodiment of a colour display tube in accordance with the invention is characterized in that a sleeve-shaped electrode is secured on the side of the anode facing the display window, in which sleeve-shaped electrode the first cup-shaped part of the focusing electrode is secured by means of a ring of an electrically insulating material. If the anode is provided with a plate having three embossed parts, each provided with an aperture, said plate may advantageously form part of the sleeve-shaped electrode. This construction enables the electron gun system to be connected in the neck of the colour display tube without using glass rods as in the known tube. The electron gun system is secured to leadthrough pins in the so-called base in the neck of the display tube by means of braces connected to the envelope of the cup-shaped anode. The second cup-shaped part of the focusing electrode and the accelerating electrode are connected together by means of suspension braces provided thereon, the ends of which are sealed in short glass rods.

BRIEF DESCRIPTION OF THE DRAWING

The invention will now be described in greater detail, by way of example with reference to the accompanying drawings, of which.

DESCRIPTION OF THE PREFERRED EMBODIMENTS

Figure 1:
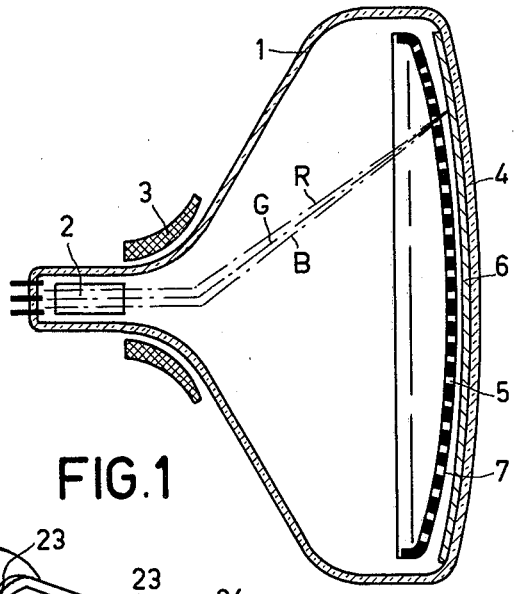
FIG. 1 is a sectional view of a colour display tube in accordance with the invention.

The colour display tube in accordance with the invention shown in FIG. 1 comprises, in an evacuated envelope 1, a diagrammatically shown electron gun system 2 to generate three electrons beams denoted by R, G and B. The three electron beams are deflected by means of a system 3 of deflection coils placed coaxially around the tube axis and intersect each other at the level of a shadow mask 5 secured at a short distance from the display window 4. The display window 4 is covered with a pattern of phosphors 6 luminescing in the colours red, green and blue. The shadow mask 5 has a large number of apertures 7 and is positioned relative to the phosphor pattern 6 in such manner that each of the electron beams is assigned to phosphor regions of one colour.

Figure 2:
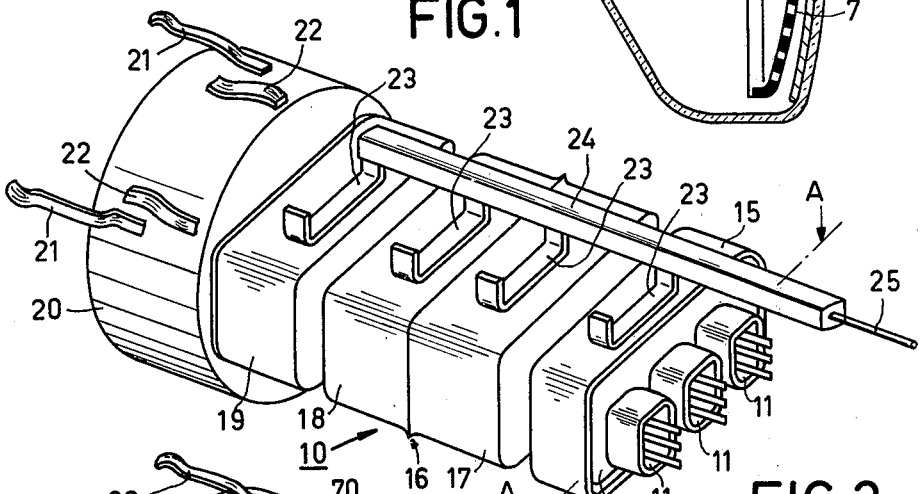
FIG. 2 is a perspective elevation of an embodiment of the electron gun system of the tube shown in FIG. 2.

FIG. 2 is a perspective elevation of an embodiment of an electron gun system in a tube in accordance with the invention. The electron gun system 10 comprises three individual cup-shaped control grids 11. A cathode is connected in each of the control grids 11 of which only the connection pins are visible in the Figure. The control grids 11 are secured in a plate of ceramic material 14 which is secured in a cup-shaped anode 15. The electron beams are focused by means of a focusing electrode 16 which is common for the three electron beams and a common accelerating electrode 19. The focusing electrode 16 consists of two cup-shaped parts 17 and 18 which are secured together at their open ends. A centering electrode 20 having contact springs 21 and centering springs 22 is mounted on the accelerating electrode 19. The contact springs 21 contact an electrically conductive layer provided internally on the tube wall. The centering springs 22 position the electron gun system 10 in the neck of the tube. The electrodes 15, 16 and 19 are provided with suspension braces 23, the ends of which are sealed in glass rods 24. Only one glass rod is shown in the Figure for clarity. The glass rods 24 are provided with a connection pin 25 to connect the electron gun system 10 to leadthrough pins in the so-called base in the neck of the display tube. The control grids 11 have an oval shape so that it is possible to accommodate the electron gun system 10 in a neck having a small diameter.

Figure 3:
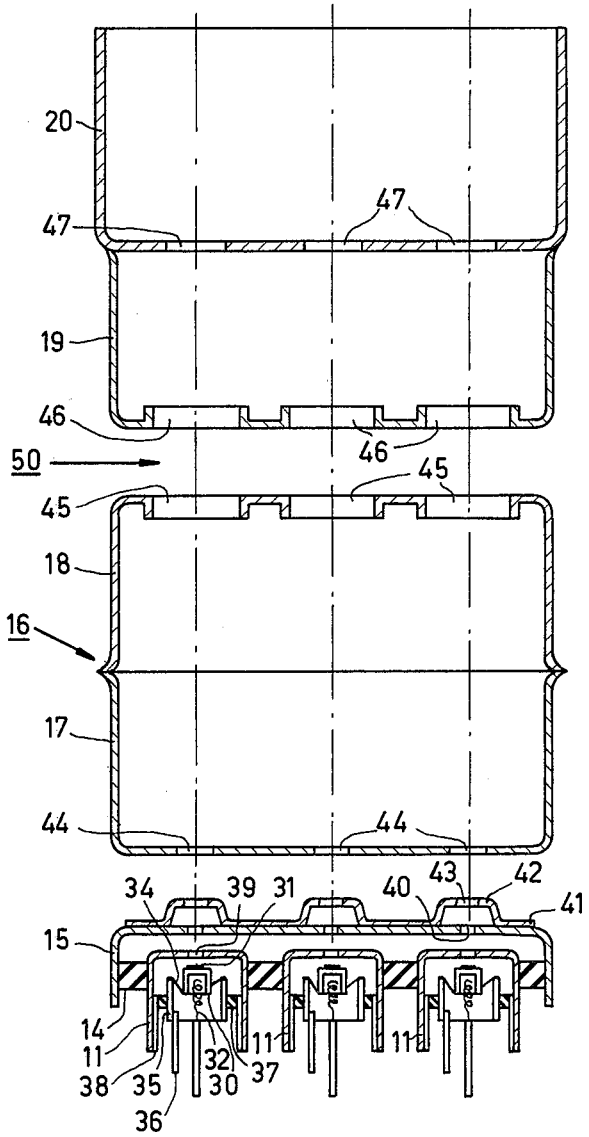
FIG. 3 is a sectional view taken on the line AA' of FIG. 2.

FIG. 3 is a sectional view taken on the line AA' of FIG. 2. A cathode 30 the end face of which is covered with an emissive layer 31 is assembled within each of the cup-shaped control electrodes 11 according to a method as is known from Netherlands patent application No. 7405552 which corresponds to U.S. Pat. No. 3,979,631. A filament 32 is accommodated within the cathode 30. The cathode 30 is secured to a first supporting sleeve 35 by means of a number of suspension supports 34. A current supply conductor 36 by which the cathode 30 can be brought to the desired potential is connected to the supporting sleeve 35. The first supporting sleeve 35 is secured in a second supporting sleeve 38 by means of a ceramic ring 37. This second supporting sleeve 38 fits in the cupshaped control electrode 11 with a small amount of play.

The oval cup-shaped control electrodes 11 have a long axis of 9.14 mm and a short axis of 5.5 mm. An aperture 39 having a diameter 0.7 mm is provided in each of the control electrodes 11. The control grids 11 are secured in the cup-shaped anode 15, having a long side of 28 mm and a short side of 12.8 mm, by means of a ceramic plate 14. The anode 15 has three apertures 40 each having a diameter of 0.7 mm. A plate 41 having three embossed parts 42 with an aperture 43 having a diameter of 3 mm is secured on the anode 15. The embossed parts 42 having apertures 43 serve to restrict the cross-sections of the electron beams at the area of the focusing lens so as to obtain the desired electron beam spot dimensions on the display screen. The focusing electrode 16, having a length of 26 mm, is positioned at a distance of 1.4 mm from the embossed parts 42 in plate 41. The focusing electrode 16 consists of two cup-shaped parts 17 and 18 which are secured together at their open ends. The part 17 has three apertures 44 each having a diameter of 3 mm and the part 18 has three apertures 45 each having a diameter of 7.11 mm. A cup-shaped accelerating electrode 19 having three apertures 46, each with a diameter of 7.6 mm, are placed at a distance of 1.3 mm from the focusing electrode 16. The focusing electrode 16 and the accelerating electrode 19 constitute a focusing lens with which the electron beams are focused on the display window. A cup-shaped centering electrode 20 having three apertures 47, each having a diameter of 4.5 mm, are secured to the open end of the accelerating electrode 19. The centering electrode 20 has centering springs with which the electron gun system is centered in the neck of the tube.

The anode 15 control grids 11, ceramic plate 14 and plate 41 can be assembled to form one assembly in a separate assembling jig prior to the actual assembly of the electron gun system 10. The plate 14, in the form of a presintered plate of ceramic material, is placed in the anode 15. The control grids 11 are then pressed into the plate, the distance from the control grids 11 to the anode 15 being adjusted and the apertures 39, 40 and 43 for each electron beam being centered relative to each other. The plate 41 is then soldered or welded to the anode 15 and the presintered plate of ceramic material is fused to the control electrodes 11 and the anode 15 by means of a heating process. In this manner, the mutual position of the control grids 11 and the centering of the apertures in the control grids 11, the anode 15 and the plate 41 is accurately fixed. Since the control grids 11 are secured in a plate of ceramic material 14, the individual suspension braces of the control grids as used in the known tube are omitted. Because of this, deviations from the adjusted positions of the electrodes, upon pressing glass rods on the suspension braces connected to the individual control grids, are avoided. Moreover, the adjusted position of the electrodes no longer varies as a result of the expansion of the suspension braces of the individual control electrodes. This also results in a smaller variation of the convergence of the electron beams on the display window.

The electrodes of the electron gun system 10 during operation of the tube have, for example, approximately the following potentials:

cathode 30: 0 V
control grid 11: 0 to −145 V
anode 15: 700 V
focusing electrode: 16 6.5 kV
accelerating electrode: 19 25 kV Since the position of the control grids 11 in the ceramic plate 14 is accurately fixed and upon warming up of the tube varies to a smaller extent than in known tubes, a smaller variation of the pinch-off voltage of the control grids also occurs. This is the voltage which has to be applied to the control electrodes to suppress the electron beam entirely, as is necessary during flyback.

Figure 4:
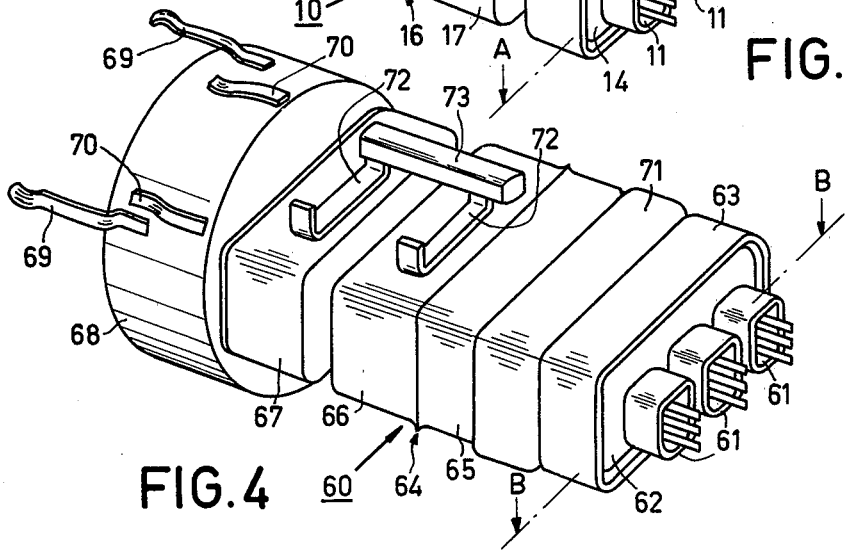
FIG. 4 is a perspective elevation of another embodiment of an electron gun system of the tube shown in FIG. 1.

FIG. 4 is a perspective elevation of another embodiment of an electron gun system for use in a tube in accordance with the invention. The electron gun system 60 again comprises three cathode control grid combinations 61 which are secured in a cup-shaped anode 63 by means of a plate of ceramic material 62. A focusing electrode 64 built up from two cup-shaped parts 65 and 66 constitutes, together with an accelerating electrode 67, a focusing lens for focusing the electron beams on the display window. A centering electrode 68 having contact springs 69 and centering springs 70 is mounted on the accelerating electrode 67. A cup-shaped electrode 71 is mounted on the anode 63. The first cup-shaped part 65 of the focusing electrode 64 is secured in the envelope of said cup-shaped electrode 71 by means of a ring of ceramic material 74. As a result of this construction, the glass rods normally provided as structural elements with which the electron gun system is secured to the lead-through pins in the base in the neck of the tube may be omitted. The electron gun system 60 now includes two parts which are manufactured separately. The anode 63 with ceramic plate 62, control grids 61, cup-shaped electrode 71 and the first part 65 of the focusing electrode 64 are positioned relative to each other in an assembly jig, after which the presintered ceramic plate 62, the anode 63 and the control grids 61 are fused by means of a heating process and the electrode 71 is fused to the cup-shaped part 65 by means of the ring of ceramic material provided between said electrodes. It is to be noted that it is known from British Pat. No. 763,951 to position electrodes relative to each other by means of a ring of ceramic material. However, the mutual position of the electrodes is determined by the dimensions of the ceramic ring. In a tube in accordance with the invention the mutual position of the electrodes is first adjusted after which said position is fixed by fusing the presintered ring of ceramic material. The second cup-shaped part 66 of the focusing electrode 64 and the accelerating electrode 67 are positioned relative to each other in a separate assembly jig. This position is fixed by means of suspension braces 72 connected to the electrodes and the ends of which are sealed in glass rods 73 of which one is shown in the Figure. The braces 72 with the glass rods 73 may be assembled beforehand. The assembly is then secured to the electrodes 66 and 67 by means of contactless welding. The two parts of the electron gun system 60 are then positioned relative to each other and the open ends of the cup-shaped parts 65 and 66 of the focusing electrode 64 are secured together. The electron gun system 60 is connected to the lead-through pins in the plate 60 in the neck of the tube by means of suspension braces mounted on the envelope of the anode 63. Said suspension braces may also form part of the anode 63.

Figure 5:
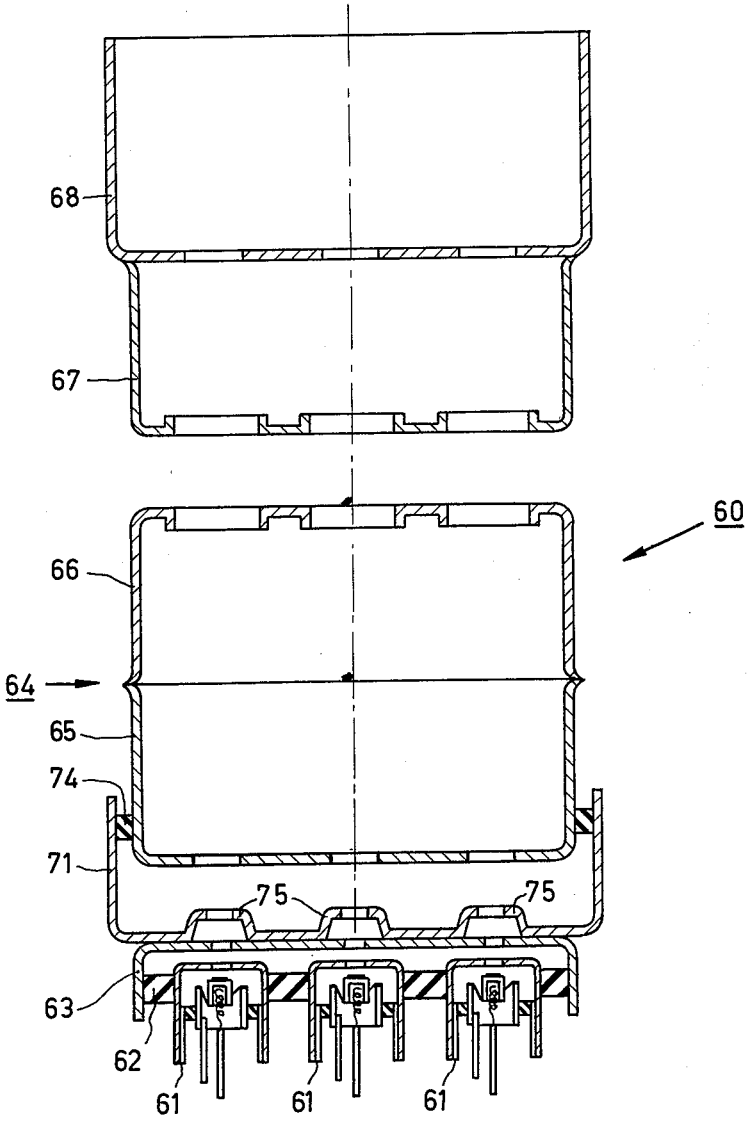
FIG. 5 is a sectional view taken on the line BB' of FIG. 4.

The connection of the electrode 71 to the cup-shaped part 65 of the focusing electrode 64 will be described in greater detail with reference to FIG. 5 which is a sectional view taken on the line BB′ of FIG. 4. The cup-shaped electrode 71 forms one assembly with a plate having three embossed parts 75 which serve as elements in the electron gun system 60 to restrict the diameter of the electron beam. The cup-shaped electrode 65 and the cup-shaped electrode 71 are secured together by means of a ceramic ring 74. Upon assembly the ceramic ring 74 can simply be placed between the electrodes 71 and 65 as a ring of presintered material.

What is claimed is:

1. An electron gun system for a color display tube of the type in which a plurality of electron beams are directed onto a display window of the tube, said electron gun system comprising:

(a) a plurality of electron-beam-producing cathodes, each secured in a control grid having an aperture for passing the respective beam;

(b) an anode, spaced from the control grids and having a plurality of apertures for passing the respective electron beams; and (c) means for focusing the electron beams onto the display window;

characterized in that the anode is cup-shaped and that a plate of insulating material, having a plurality of respective apertures into which the control grids are inserted, is fixed to the control grids and the anode, thereby securely positioning the control grids relative to each other and to the apertures in the anode.

2. An electron gun system as in claim 1, characterized in that the focusing means includes an electrode having a tubular wall portion, and that a cup-shaped electrode having a plurality of apertures for passing the respective electron beams is attached to the side of the anode facing away from the cathodes, and that a ring of insulating material positioned between the cup-shaped electrode and said tubular wall portion is fixed to the tubular wall portion and to the cup-shaped electrode.

3. An electron gun system as in claim 2, characterized in that said cup-shaped electrode includes a plurality of respective embossed portions in which the apertures are located.

4. An electron gun system as in claim 1, 2 or 3, characterized in that said insulating material is a presintered ceramic.

* * * * *